US008985004B2

(12) United States Patent
DeJong

(10) Patent No.: US 8,985,004 B2
(45) Date of Patent: Mar. 24, 2015

(54) FIREARMS FOR FIRING SHOTSHELL TYPE AMMUNITION

(71) Applicant: Intrepid Tactical Solutions, LLC, Salt Lake City, UT (US)

(72) Inventor: William E. DeJong, Hayden, ID (US)

(73) Assignee: Intrepid Tactical Solutions, LLC, Salt Lake City, UT (US)

( * ) Notice: Subject to any disclaimer, the term of this patent is extended or adjusted under 35 U.S.C. 154(b) by 0 days.

(21) Appl. No.: 14/042,007

(22) Filed: Sep. 30, 2013

(65) Prior Publication Data

US 2014/0283673 A1 Sep. 25, 2014

Related U.S. Application Data

(62) Division of application No. 13/592,798, filed on Aug. 23, 2012.

(60) Provisional application No. 61/527,942, filed on Aug. 26, 2011.

(51) Int. Cl.
*F41A 21/12* (2006.01)
*F42B 5/30* (2006.01)
(Continued)

(52) U.S. Cl.
CPC . *F41A 21/12* (2013.01); *F42B 7/04* (2013.01); *F41C 7/00* (2013.01); *F41A 5/00* (2013.01); *F41A 9/64* (2013.01)
USPC ..... 89/125; 102/466; 102/449; 102/439; 42/76.01

(58) Field of Classification Search
CPC ..... F42B 7/00; F42B 7/02; F42B 7/04; F42B 7/043; F42B 7/06; F42B 7/08; F42B 7/10; F42B 7/12
USPC ..... 42/6, 13, 76.01, 78; 89/14.05, 14.6, 89/125, 194
See application file for complete search history.

(56) References Cited

U.S. PATENT DOCUMENTS 338,192 A * 3/1886 Rubin, E. ..... 42/78
1,557,695 A 10/1925 Roy
(Continued)

FOREIGN PATENT DOCUMENTS

WO 8301300 A1 4/1983
WO 9940387 A1 8/1999

OTHER PUBLICATIONS

International Search Report and Written Opinion for PCT application No. PCT/US2012/052023, mailed Apr. 25, 2013.
(Continued)

*Primary Examiner* — Bret Hayes
*Assistant Examiner* — Derrick Morgan
(74) *Attorney, Agent, or Firm* — TraskBritt, P.C.

(57) ABSTRACT

Shotshell type ammunition includes a hull, a sabot disposed within the hull, and at least one projectile disposed within the sabot. The hull has a rimless first end that includes a primer for firing the ammunition. The hull also has a seat surface for seating the hull against a complementary seat surface in a firing chamber of a firearm. The seat surface is located a distance from an outer end surface of the hull at the rimless first end. The hull further includes an outer cylindrical side surface extending from the rimless first end of the hull to the seat surface of the hull. Methods of fabricating such ammunition includes forming such a hull, providing one or more projectiles within a sabot, and disposing the sabot with the one or more projectiles therein at least partially into the hull. Shotgun type firearms are configured for firing such ammunition.

12 Claims, 8 Drawing Sheets

(51) Int. Cl.

| | |
|---|---|
| ***F42B 7/04*** | (2006.01) |
| ***F41C 7/00*** | (2006.01) |
| ***F41A 5/00*** | (2006.01) |
| ***F41A 9/64*** | (2006.01) |

(56) References Cited

U.S. PATENT DOCUMENTS

| | | | | | |
|---|---|---|---|---|---|
| 1,557,696 | A | | 10/1925 | Roy | |
| 2,766,692 | A | | 10/1956 | Mynes | |
| 2,840,944 | A | | 7/1958 | Thompson | |
| 2,869,270 | A | * | 1/1959 | Simmons | 42/76.01 |
| 3,179,051 | A | * | 4/1965 | Morse | 102/452 |
| 3,283,720 | A | | 11/1966 | Foote et al. | |
| 3,527,137 | A | * | 9/1970 | Scanlon | 89/1.1 |
| 3,598,057 | A | | 8/1971 | Potter | |
| 3,602,086 | A | * | 8/1971 | Billingslea et al. | 89/7 |
| 3,609,904 | A | * | 10/1971 | Scanlon | 42/76.01 |
| 4,085,677 | A | | 4/1978 | Marcinkiewicz | |
| 4,194,657 | A | | 3/1980 | Thor | |
| 4,290,365 | A | | 9/1981 | Dreyer | |
| 4,479,438 | A | | 10/1984 | Bilsbury | |
| 4,553,480 | A | * | 11/1985 | McLellan | 102/430 |
| 4,614,051 | A | * | 9/1986 | Thacker | 42/12 |
| 4,686,905 | A | * | 8/1987 | Szabo | 102/444 |
| 4,742,774 | A | | 5/1988 | Flatau | |
| 5,221,809 | A | | 6/1993 | Cuadros | |
| 5,408,931 | A | | 4/1995 | Tallman | |
| 5,644,100 | A | | 7/1997 | Puckett et al. | |
| 5,829,180 | A | * | 11/1998 | Leiter | 42/77 |
| 6,324,984 | B1 | | 12/2001 | Dindl | |
| 6,367,388 | B1 | | 4/2002 | Billings | |
| 7,228,801 | B2 | | 6/2007 | Dunnam et al. | |
| 7,357,082 | B1 | | 4/2008 | Racho | |
| 7,380,363 | B1 | * | 6/2008 | Kirschner | 42/76.01 |
| 7,610,857 | B1 | | 11/2009 | Dunnam et al. | |
| 7,926,424 | B1 | | 4/2011 | Quintana et al. | |
| 7,941,957 | B2 | * | 5/2011 | Carr et al. | 42/73 |
| 8,001,903 | B1 | * | 8/2011 | Quintana et al. | 102/458 |
| 8,122,633 | B2 | * | 2/2012 | Kerbrat et al. | 42/20 |
| 8,161,886 | B2 | * | 4/2012 | Meyer | 102/520 |
| 8,281,699 | B2 | * | 10/2012 | Jebsen et al. | 89/24 |
| 8,572,878 | B2 | * | 11/2013 | Gentilini et al. | 42/69.01 |
| 2003/0167958 | A1 | | 9/2003 | Johansson | |
| 2004/0244629 | A1 | | 12/2004 | Jopson | |
| 2005/0183616 | A1 | | 8/2005 | Eberhart | |
| 2005/0211125 | A1 | | 9/2005 | Amick | |
| 2006/0236888 | A1 | | 10/2006 | Brunn | |
| 2007/0214992 | A1 | * | 9/2007 | Dittrich | 102/469 |
| 2007/0272112 | A1 | | 11/2007 | Nielson et al. | |
| 2007/0272113 | A1 | | 11/2007 | Meyer et al. | |
| 2008/0163533 | A1 | | 7/2008 | Racho | |
| 2010/0037794 | A1 | | 2/2010 | Authement, Sr. | |
| 2010/0064566 | A1 | * | 3/2010 | Kerbrat et al. | 42/1.06 |
| 2010/0282110 | A1 | | 11/2010 | Sexton | |
| 2011/0041680 | A1 | * | 2/2011 | Smirnov | 89/125 |
| 2011/0168009 | A1 | * | 7/2011 | Robb et al. | 89/194 |
| 2012/0167755 | A1 | * | 7/2012 | Rosol et al. | 89/188 |
| 2012/0304518 | A1 | * | 12/2012 | Kerbrat et al. | 42/1.06 |
| 2013/0047880 | A1 | | 2/2013 | O'Dwyer | |
| 2013/0291419 | A1 | * | 11/2013 | Heath | 42/50 |
| 2014/0130696 | A1 | * | 5/2014 | DeJong | 102/448 |
| 2014/0130697 | A1 | * | 5/2014 | DeJong | 102/450 |

OTHER PUBLICATIONS

Saiga-12, Wikipedia: the Free Encyclopedia, last modified Jun. 2, 2013, <http://en.wikipedia.org/wiki/Saiga_12>.

MKA 1919: Wikipedia: the Free Encyclopedia, last modified Jun. 4, 2013, <http://en.wikipedia.org/wiki/Akdal_MKA_1919>.

Snake/Rat Shot; Wikipedia: the Free Encyclopedia, last modified Jun. 4, 2013, <http://en.wikipedia.org/wiki/Rat_shot>.

Campbell, R.K., Handgun Shot Loads Work for Pests Bu Not Defense, no date; <http://www.gunweek.com/2005/feature1001.html>.

Pest Control/Specialty, CCI The Leader in Rimfire Ammunition, no date, <http://www.cci-ammunition.com/products/pestcontrol_specialty.aspx>.

* cited by examiner

FIREARMS FOR FIRING SHOTSHELL TYPE AMMUNITION

CROSS-REFERENCE TO RELATED APPLICATION

This application is a divisional of U.S. patent application Ser. No. 13/592,798, filed Aug. 23, 2012, pending, which claims the benefit of U.S. Provisional Patent Application Ser. No. 61/527,942, filed Aug. 26, 2011 and entitled "Rimless Shotshell," which is incorporated herein in its entirety by this reference.

TECHNICAL FIELD

The present disclosure relates to shotshell type ammunition for shotgun type firearms, to shotgun type firearms configured for firing shotshell type ammunition, and to methods of manufacturing such shotshell type ammunition.

BACKGROUND

Conventional shotshell ammunition for firing from a shotgun has a hull that includes a metal cup-shaped structure defining a closed firing end of the ammunition, and a cylindrical portion that extends from the metal-cup shaped structure. A primer is provided at the firing end of the ammunition in an aperture extending through the cup-shaped structure. Gun powder is disposed within the hull within the metal cup-shaped structure and adjacent the primer. One or more projectiles are disposed within a sabot, and the sabot is disposed within the hull adjacent the gun powder such that the gun powder is disposed in a space between the metal cup-shaped structure of the hull and the sabot with the projectile therein. As used herein, the term "sabot" means a structure in which a projectile is carried through a barrel of a firearm and which separates from the projectile upon exiting the barrel of the firearm. The projectile may include a plurality of generally spherical rounded pellets, which are often referred to as the "shot" of the ammunition. The cylindrical portion of the hull is typically formed of plastic, and an end of the plastic cylindrical portion of the hull opposite the metal cup-shaped structure is mechanically deformed (by rolling, folding, etc.) and crimped to close the end of the ammunition opposite the firing end of the ammunition from which the sabot (and the one or more projectiles carried therein) exits the hull upon firing of the ammunition.

In conventional shotshell ammunition, the cylindrical portion of the hull has a maximum outer diameter that is smaller than a maximum outer diameter of the metal cup-shaped structure defining the closed firing end of the ammunition. Thus, the cup-shaped structure includes or defines a rim that projects outwardly in the radial direction beyond the outer surface of the cylindrical portion of the hull, and, in some previously known ammunition, a portion of the metal-cup-shaped structure having a reduced outer diameter. Conventional shotguns include a seat surface that is configured to abut against the metal rim at the firing end of the ammunition so as to prevent longitudinal forward movement of the hull within the shotgun when the shotshell type ammunition is fired from the shotgun.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes shotshell type ammunition. The shotshell type ammunition includes a hull, a sabot disposed within the hull, and at least one projectile disposed within the sabot. The hull has a rimless first end that includes a primer for firing the ammunition. The hull has an opposing second end from which the at least one projectile may be ejected out from the hull upon firing the ammunition. The hull also has a seat surface for seating the hull against a complementary seat surface in a firing chamber of a firearm. The seat surface is located a distance from an outer end surface of the hull at the rimless first end. The hull further includes an outer cylindrical side surface extending from the rimless first end of the hull to the seat surface of the hull.

The present disclosure further includes shotgun type firearms configured to fire shotshell type ammunition as described herein. For example, in some embodiments, the present disclosure includes a shotgun type firearm having a firing chamber sized and configured to fire such shotshell type ammunition. The firearm includes a generally cylindrical inner surface extending through a headspace within the firing chamber. The generally cylindrical inner surface may have a length of at least about 0.318 centimeters (about ⅛ of an inch). The firearm further includes a seat surface within the firing chamber, which seat surface is configured to abut against a complementary seat surface of a hull of a shotshell type ammunition to be fired from the firearm and to prevent longitudinal forward movement of the hull within the firearm when the shotshell type ammunition is fired from the firearm.

In yet further embodiments, the present disclosure includes methods of manufacturing shotshell type ammunition as described herein. For example, a hull may be formed that has a rimless first end, and an opposing second end from which a projectile may be ejected out from the hull upon firing the ammunition. The hull also may be formed to have a seat surface for seating the hull against a complementary seat surface in a firing chamber of a firearm. The seat surface of the hull may be located a distance from an outer end surface of the hull at the rimless first end. The hull also may be formed to include an outer cylindrical side surface extending from the rimless first end of the hull to the seat surface of the hull. After forming the hull, a primer for firing the ammunition may be provided at the rimless first end of the hull. At least one projectile may be provided within a sabot, and the sabot may be inserted at least partially into the hull.

DETAILED DESCRIPTION

The illustrations presented herein are not meant to be actual views of any particular ammunition round, firearm, or component thereof, but are merely idealized representations that are used to describe embodiments of the disclosure.

Figure 1:
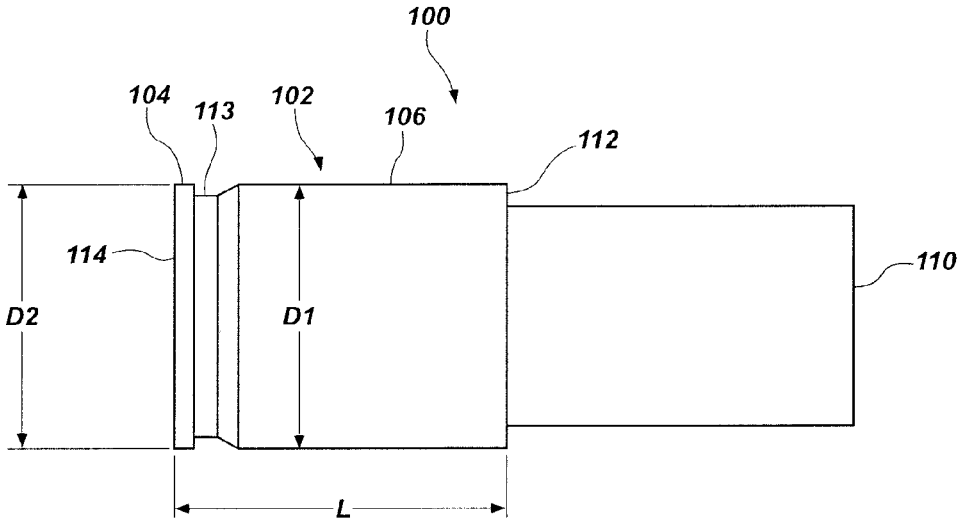
FIG. 1 is a longitudinal side view of an embodiment of shotshell type ammunition of the present disclosure.
Figure 2:
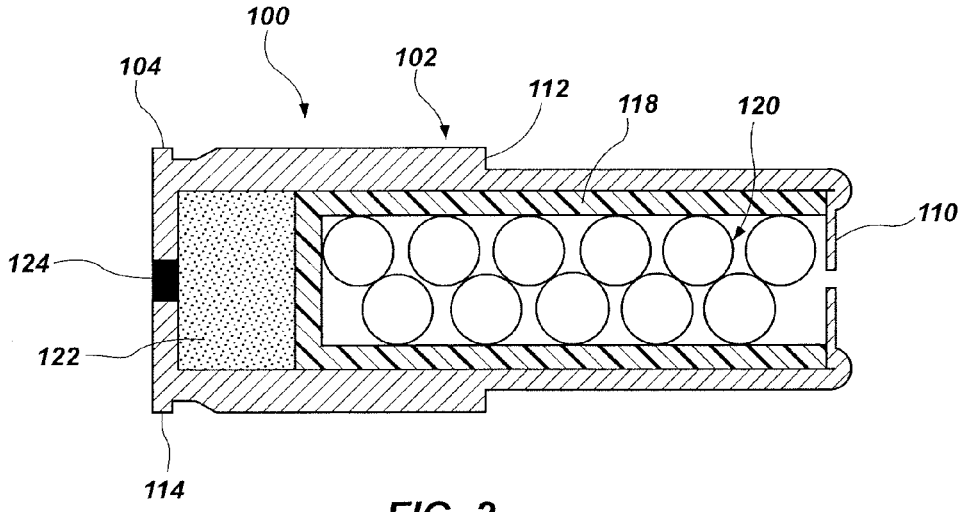
FIG. 2 is a longitudinal cross-sectional side view of the shotshell type ammunition of FIG. 1.

FIGS. 1 and 2 illustrate an embodiment of a shotshell type ammunition 100 of the present disclosure. The shotshell type ammunition 100 includes a hull 102, gun powder 122 (FIG. 2) disposed within the hull 102, a sabot 118 (FIG. 2) disposed within the hull 102, and at least one projectile 120 (FIG. 2) disposed within the sabot 118.

The hull 102 has a rimless first end 104, an opposing second end 110, and a seat surface 112 for seating the hull 102 against a complementary seat surface in a firing chamber of a firearm. The seat surface 112 may be located a distance from an outer end surface 114 of the hull 102 at the rimless first end 104. An outer cylindrical side surface 106 may extend from the rimless first end 104 of the hull 102 to the seat surface 112 of the hull 102. The outer cylindrical side surface 106, the outer end surface 114, and the seat surface 112 may define what is referred to in the art as the "head space" of the shotshell type ammunition 100. The seat surface may be sized and configured to abut against a complementary seat surface in a firing chamber of a firearm, as described in further detail herein below, and may be used for ensuring precise and accurate positioning of the shotshell type ammunition 100 within the firing chamber of a firearm.

The hull 102 may comprise, for example, a metal or a polymer such as a plastic material. In some embodiments, a portion of the hull 102 may comprise a metal, and another portion of the hull 102 may comprise a polymer such as a plastic. For example, the rimless first end 104 of the hull 102 and a portion of the hull 102 comprising the outer cylindrical side surface 106 of the hull 102 may comprise a metal, and a portion of the hull 102 between the seat surface 112 and the second end 110 of the hull may comprise a polymer, such as a plastic material.

The shotshell type ammunition 100 may include a groove 113 extending into the hull 102 on a lateral side of the hull 102 proximate the rimless first end 104 of the hull 102. The groove 113 may be located and configured for use by a mechanism of a firearm to eject the shotshell type ammunition 100 out from the firearm after firing the shotshell type ammunition 100.

As shown in FIG. 2, the rimless first end 104 of the hull 102 may include a primer 124 for firing the ammunition 100. When struck by a firing pin of a shotgun type firearm, the primer 124 may ignite the gunpowder 122 within the hull 102, which in turn may eject the sabot 118 (with the at least one projectile 120 carried therein) out from the second end 110 of the hull 102.

The at least one projectile 120 disposed within the sabot 118 shown in FIG. 2 may be any of a number of different types of projectiles. Further, the at least one projectile may comprise one projectile, or more than one projectile. Thus, as a non-limiting example, the at least one projectile may comprise a plurality of rounded pellets, which are often referred to in the art as "shot." In other embodiments, however, at least one projectile may comprise a metal slug, for example. In yet further embodiments, the at least one projectile may comprise a non-lethal or less-lethal projectile, such as one or more rubber masses, a bean bag, etc. In yet further embodiments, the at least one projectile may include an electronic device that is operational after it has been fired from a firearm, such as an electronic audio transmitter device configured to detect audible sound in the vicinity of the devices and to wirelessly transmit electronic signals carrying the detected audible sounds.

The opposing second end 110 of the hull 102 may be closed using any appropriate technique, including, folding and/or crimping an end of the hull 102.

The seat surface 112 may be located a distance L from the outer end surface 114 of the hull 102 so as to define the outer cylindrical side surface 106. In some embodiments, the distance L may be at least about 0.318 centimeters (about ⅛ of an inch), at least about 0.635 centimeters (about ¼ of an inch), at least about 1.270 centimeters (about ½ of an inch), or even at least about 2.540 centimeters (about 1 inch).

The outer cylindrical side surface 106 of the hull 102 may define a maximum diameter of the shotshell type ammunition 100. Thus, the first end 104 of the hull 102 is referred to herein as a "rimless" first end 104 because the first end 104 does not project laterally outward from the hull radially beyond the outer cylindrical side surface 106. In other words, the diameter of the hull 102 at the first end 104 is equal to or less than the diameter of the outer cylindrical side surface 106 of the hull 102, which extends to the seat surface 112 and may have a length as previously described. Stated another way, the outer cylindrical side surface 106 may have a first diameter $D_1$, and the outer end surface 114 of the hull 102 at the rimless first end 104 may have a second diameter $D_2$ at least substantially equal to or smaller than the first diameter $D_1$.

In contrast, previously known standard shotshell type ammunition has a rimmed first end, wherein the first end of the hull projects laterally outward radially beyond the cylindrical portion of the hull, so as to define a rim at the first end of the ammunition which is used to seat the ammunition within the firearm (the function performed by the seat surface 112 in embodiments of the present disclosure). In other words, the diameter $D_2$ is greater than the diameter $D_1$ in previously known standard shotshell type ammunition.

With continued reference to FIGS. 1 and 2, the diameter $D_1$ of the outer cylindrical side surface 106 of the hull 102 may vary depending on the size of the shotgun type firearm from which the ammunition is to be fired. As known in the art, shotgun type firearms commonly have one of a 10 gauge bore size, a 12 gauge bore size, a 16 gauge bore size, and a 20 gauge bore size. As non-limiting examples, Table 1 below provides ranges for the maximum diameter $D_1$ of the outer cylindrical side surface 106 of the hull 102 for different firearm bore sizes.

TABLE 1

| Bore Size | Maximum Diameter $D_1$ |
|---|---|
| 10 Gauge | 2.146 centimeters (about 0.845 inches) to 2.370 centimeters (about 0.933 inches) |
| 12 Gauge | 2.032 centimeters (about 0.800 inches) to 2.250 centimeters (about 0.886 inches) |
| 16 Gauge | 1.867 centimeters (about 0.735 inches) to 2.080 centimeters (about 0.819 inches) |
| 20 Gauge | 1.775 centimeters (about 0.699 inches) to 1.948 centimeters (about 0.767 inches) |

The ranges provided in Table 1 are provided as examples only, and the maximum diameter $D_1$ of the outer cylindrical side surface 106 of the hull 102 may be outside the ranges set forth in Table 1 for the corresponding firearm bore size in additional embodiments of the disclosure.

Figure 3:
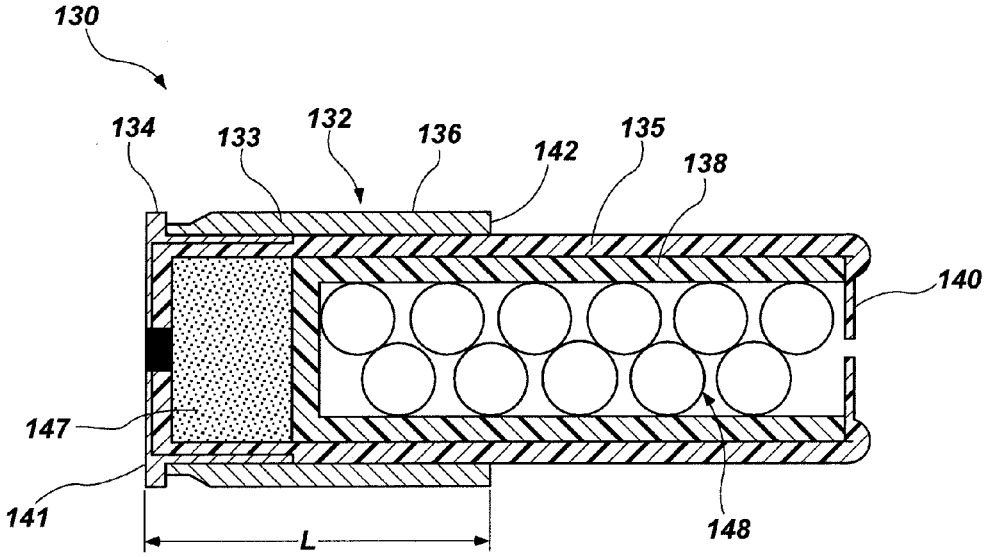
FIG. 3 is a longitudinal cross-sectional side view of another embodiment of shotshell type ammunition of the present disclosure similar to that of FIGS. 1 and 2.

FIG. 3. illustrates another embodiment of a shotshell type ammunition 130 of the present disclosure. The shotshell type ammunition 130 is generally similar to that shown in FIG. 1, and includes a hull 132, gun powder 147 disposed within the hull 132, a sabot 138 disposed within the hull 132, and at least one projectile 148 disposed within the sabot 138. The gun powder 147, sabot 138, and at least one projectile 148 may be as previously described with reference to FIG. 1.

The hull 132 of the ammunition 130, like the ammunition 100, has a rimless first end 134, an opposing second end 140, and a seat surface 142 for seating the hull 132 against a complementary seat surface in a firing chamber of a firearm. The seat surface 142 may be located a distance L from an outer end surface 141 of the hull 132 at the rimless first end 134, as described with reference to FIG. 1. An outer cylindrical side surface 136 may extend from the rimless first end 134 of the hull 132 to the seat surface 142 of the hull 132.

The hull 132 of FIG. 3, however, has a multi-part construction, and may include a cylindrical portion 135 that extends from the rimless first end 134 of the hull 132, and a cylindrical ring member 133 disposed concentrically around the cylindrical portion 135. In some embodiments, the ammunition 130 may be formed by disposing a cylindrical ring member 133 around the cylindrical portion of the hull of a conventional, previously known shotshell type ammunition. A longitudinal end surface of the cylindrical ring member 133 defines the seat surface 142 of the hull 132. An outer cylindrical side surface of the cylindrical ring member 133 defines the outer cylindrical side surface 136 of the hull 132 extending from the rimless first end 134 of the hull 132 to the seat surface 142 of the hull 132.

As non-limiting examples, the cylindrical portion 135 may comprise a plastic material, and the cylindrical ring member 133 may comprise a metal.

The opposing second end 140 of the hull 132 may be closed by, for example, folding and/or crimping the opposing second end 140 of the hull 132, which comprises an end of the cylindrical portion 135.

Figure 4:
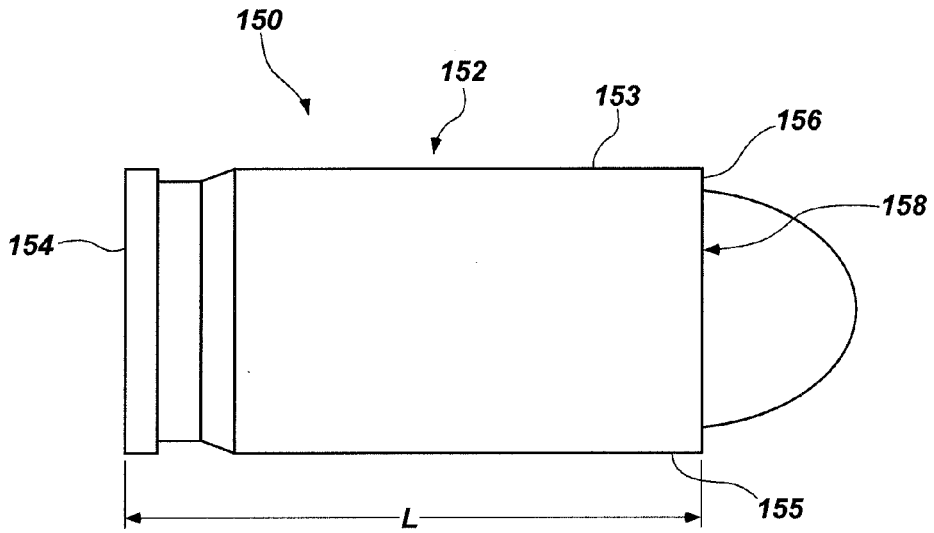
FIG. 4 is a longitudinal side view of another embodiment of shotshell type ammunition of the present disclosure.
Figure 5:
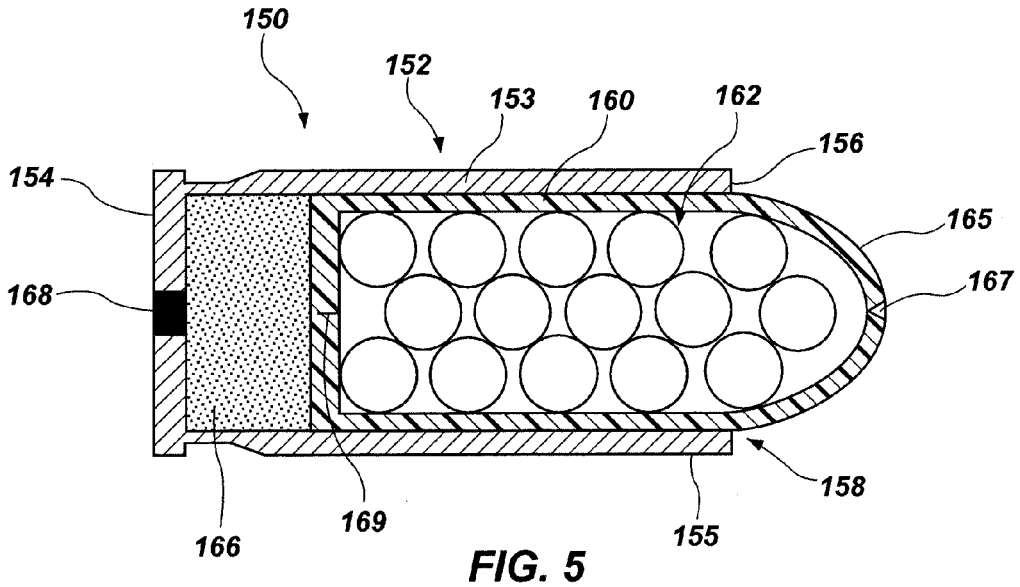
FIG. 5 is a longitudinal cross-sectional side view of the shotshell type ammunition of FIG. 4.

FIGS. 4 and 5 illustrate another embodiment of a shotshell type ammunition 150 of the disclosure. The shotshell type ammunition 150 includes a hull 152, gun powder 166 disposed within the hull 152, a sabot 160 disposed at least partially within the hull 152, and at least one projectile 162 disposed with the sabot 160. Like the previously described hulls, the hull 152 has a rimless first end 154. The hull 152 also has an opposing second end 158, and a seat surface 156 for seating the hull 152 against a complementary seat surface in a firing chamber of a firearm. In the embodiment shown in FIGS. 4 and 5, the second end 158 of the hull 152 is open, and a forward end of the sabot 160 projects out from and longitudinally beyond the open second end 158 of the hull 152.

The hull 152 includes a cylindrical portion 153 that extends from the rimless first end 154 of the hull 152 to the open second end 158 of the hull 152. A longitudinal end surface of the cylindrical portion 153 defines the seat surface 156 of the hull 152. An outer cylindrical side surface 155 of the cylindrical portion 153 of the hull 152 may extend from at least proximate the rimless first end 154 of the hull 152 to the seat surface 156 of the hull 152. The diameter of the outer cylindrical side surface 155 of the cylindrical portion 153 defines a maximum diameter of the hull 152.

The cylindrical portion 153 and the rimless first end 154 of the hull 152 may comprise regions of a single unitary body in some embodiments. In other embodiments, they may comprise portions of the hull 152 that are formed separately from one another and subsequently assembled and/or bonded together. The hull 152 may comprise, for example, a metal or a polymer, such as a plastic material. In some embodiments, each of the rimless first end 154 and the cylindrical portion 153 of the hull 152 may comprise a polymer material. As non-limiting examples, such a polymer material may comprise a polycarbonate material, or a nylon material. Further, the polymer material may include a discontinuous filler material, such as glass particles (e.g., fibers).

As shown in FIG. 5, a portion of the sabot 160 is contained within the hull 152, and at least one projectile 162 is disposed within the sabot 160. The at least one projectile 162 disposed within the sabot 160 may be entirely surrounded by and enclosed within the sabot 160 prior to firing the ammunition 150.

As previously mentioned, the sabot 160 may project longitudinally beyond the seat surface 156 at the open end 158 of the cylindrical portion 153 of the hull 152 prior to firing the shotshell type ammunition 150. The sabot 160 may have a forward rounded end surface 165 that projects longitudinally beyond the seat surface 156. The rounded end surface 165 may project beyond the end surface at the open end of the cylindrical portion 153 prior to firing of the shotshell type ammunition 150. The rounded end surface 165 may have, for example, a cone shape or a dome shape. In other embodiments, the sabot 160 may not have a rounded end surface 165, but may instead be flat, for example.

The sabot 160 may include two or more portions that fold together to enclose the one or more projectiles 162 therein. As the sabot 160 (with the one or more projectiles 162 carried therein) exits the barrel of a firearm upon firing the ammunition 150, the two or more portions of the sabot 160 may at least partially separate from one another so as to release the projectiles 162 from the sabot 160. The sabot 160 may include at least one feature, such as a recess or aperture 167, at the forward rounded end surface 165 of the sabot 160, which may be configured to urge the at least partial separation of the sabot and release of the one or more projectiles 162 as the sabot 160 exits the barrel of a firearm upon firing the ammunition 150. In some embodiments, a portion of the sabot 160 may define a hinge member 169 that connects the two or more separable portions of the sabot 160 such that the portions do not completely separate from one another upon firing the ammunition 152.

The sabot 160 may be retained within the hull 152 using, for example, an interference fit between the sabot 160 and the hull 152. For example, the sabot 160 may have a cylindrical outer side surface having a maximum diameter, and the hull 152 may have a cylindrical inner side surface having a minimum diameter equal to or smaller than the maximum diameter of the cylindrical outer side surface of the sabot 160. In such a configuration, the sabot 160 may be inserted into the hull 152 using a press-fitting process and/or a shrink-fitting process, for example. The mechanical interference between the cylindrical outer side surface of the sabot 160 and the cylindrical inner side surface of the hull 152 retains the sabot 160 within the hull 152 until the ammunition 152 is fired from a firearm.

As shown in FIG. 5, the rimless first end 154 of the hull 152 may include a primer 168 for firing the ammunition 150. When struck by a firing pin of a shotgun type firearm, the primer 168 may ignite the gunpowder 166 within the hull 152, which in turn may eject the sabot 160 (with the at least one projectile 162 carried therein) out from the second end 158 of the hull 152.

The one or more projectiles 162 within the sabot 160 of the ammunition 150 may be as previously described in relation to the one or more projectiles 120 of the ammunition 100, with reference to FIGS. 1 and 2.

Similar to the ammunition 100 of FIGS. 1 and 2, the seat surface 156 may be located a distance L from an outer end surface of the hull 152 at the rimless first end 154, and, as non-limiting examples, the distance L may be at least about 0.318 centimeters (about ⅛ of an inch), at least about 0.635 centimeters (about ¼ of an inch), at least about 1.270 centimeters (about ½ of an inch), or even at least about 2.540 centimeters (about 1 inch).

The outer cylindrical side surface 155 of the hull 152 may define a maximum diameter of the shotshell type ammunition 150. The first end 154 of the hull 152 is rimless, as the first end 154 does not project laterally outward from the hull 152 radially beyond the outer cylindrical side surface 155. In other words, the diameter of the hull 152 at the first end 154 is equal to or less than diameter of the outer cylindrical side surface 155 of the hull 152, which extends to the seat surface 156 and may have a length as previously described. The diameter of the outer cylindrical side surface 155 of the hull 152 may vary depending on the size of the shotgun type firearm from which the ammunition is to be fired, as previously discussed. As non-limiting examples, the maximum diameter of the outer cylindrical side surface 155 of the hull 152 may be within the ranges set forth in Table 1 above for the different corresponding firearm bore sizes.

The second end of the shotshell type ammunition 150 is not crimped, as is conventional shotshell type ammunition. As a result, the interior surface of the barrel of a firearm used to fire the shotshell type ammunition 150 does not need to include a forcing cone (a frustoconical shaped portion of the interior surface), as do the barrels of conventional shotgun type firearms used to fire conventional shotshell type ammunition. Thus, the interior surface of the barrel of a shotgun type firearm configured to fire the shotshell type ammunition 150 may have an at least substantially uniform diameter extending from a location of the seat surface 156 when the ammunition 150 is fully seated within the barrel to a location proximate the distal end of the barrel (but for any variation provided by a so-called "choke tube," which is commonly employed at the distal end of the barrel of shotgun type firearms). The lack of such a forcing cone in embodiments of firearms of the present disclosure may reduce recoil felt by users of such firearms.

Figure 6:
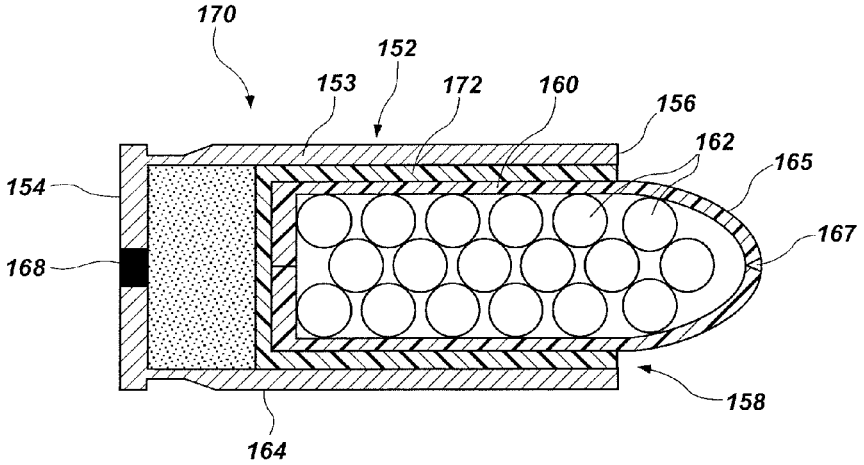
FIG. 6 is a longitudinal cross-sectional side view of another embodiment of shotshell type ammunition of the present disclosure similar to that of FIGS. 4 and 5.

FIG. 6 illustrates another embodiment of a shotshell type ammunition 170 similar to that of FIGS. 4 and 5, but further including an additional sabot 172 disposed between the sabot 160 and the hull 152. In other words, the additional sabot 172 may be disposed within the hull 152 of the shotshell type ammunition 170, and the sabot 160 that encloses the one or more projectiles 162 may be disposed within the additional sabot 172. The additional sabot 172 may have a configuration similar to previously known standard configurations for sabots (e.g., a "wad") in shotshell type ammunition, and may be used to provide a relatively tighter gas-tight seal between the sabot 160 and the barrel of a firearm from which the ammunition 170 is fired. For example, the additional sabot may have a cup-shaped configuration that includes two or more portions that, when folded together, form a generally cylindrical side wall that extends from a first closed end to an open second end. The sabot 160 may protrude from the open second end of the additional sabot 172 prior to firing of the ammunition 150 in some embodiments.

Figure 7:
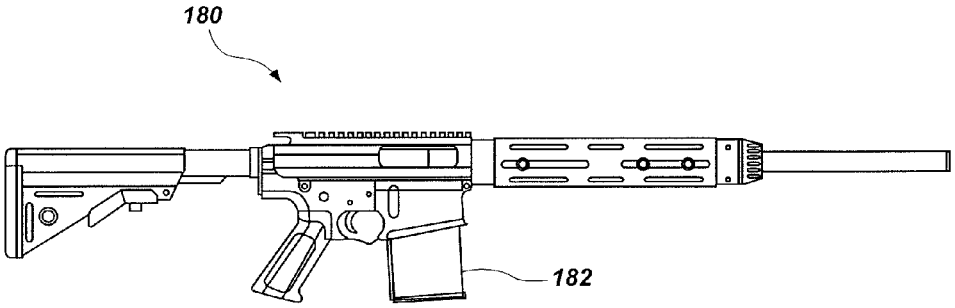
FIG. 7 is a side view of an embodiment of a shotgun type firearm of the present disclosure configured to fire shotshell type ammunition, such as that shown in FIGS. 1 through 6.

Additional embodiments of the present disclosure include shotgun type firearms that are configured for firing shotshell type ammunition as described herein. FIG. 7 illustrates a non-limiting example embodiment of a shotgun type firearm 180 of the present disclosure. The shotgun type firearm 180 may comprise a magazine 182 configured to hold two or more rounds of shotshell type ammunition as described herein. The magazine 182 may be configured to be attached and detached from the firearm 180 in a repeatable manner. The shotgun type firearm 180 may comprise a semi-automatic or automatic repeating firearm, and ammunition may be sequentially fed from the magazine into the firing chamber of the firearm 180 in an at least substantially automatic manner upon firing the firearm. The magazine 182 may be removed from the firearm to reload the magazine 182 with ammunition, after which the magazine 182 may again be coupled with the firearm 180.

Figure 8:
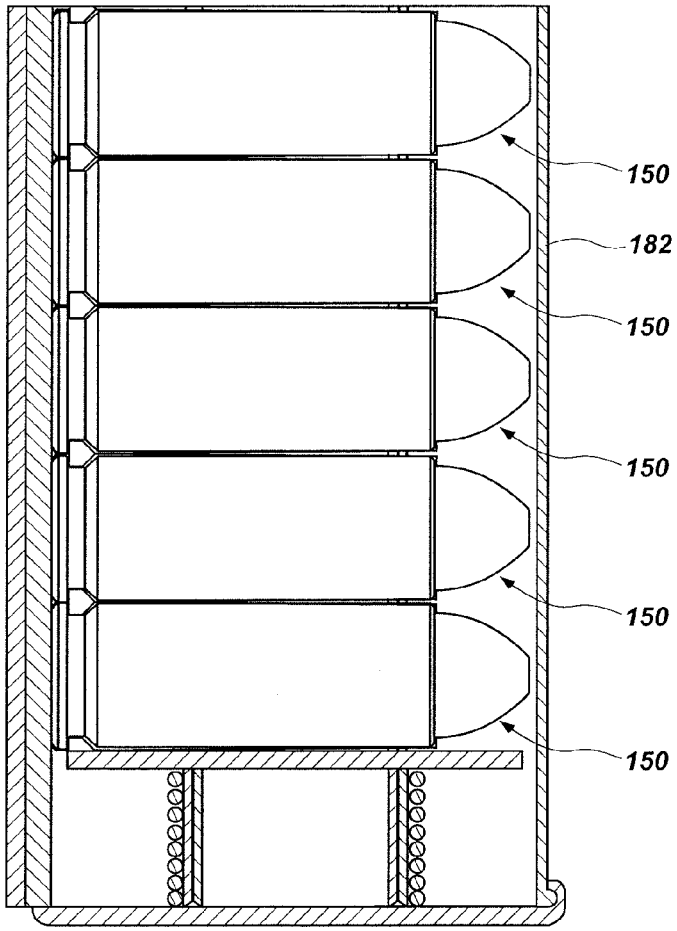
FIG. 8 is a cross-sectional view of a magazine of the firearm of FIG. 7 loaded with shotshell type ammunition as described herein.
Figure 9:
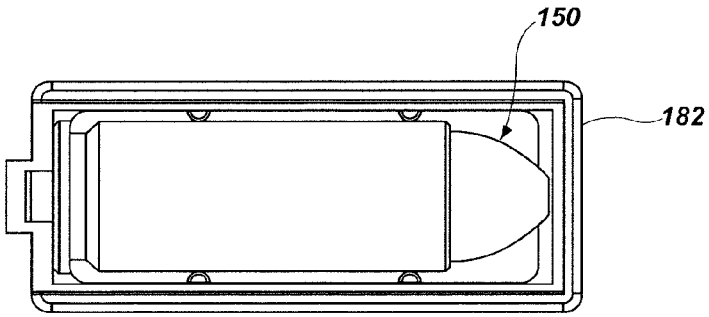
FIG. 9 is a top view of the loaded magazine of FIG. 8.

FIG. 8 illustrates a cross-sectional side view of the magazine 182 of FIG. 7, separate from the shotgun type firearm 180, and loaded with five rounds of shotshell type ammunition 150 as previously described with reference to FIGS. 3 and 4. As shown in FIG. 8, the shotshell type ammunition 150 may be configured in a vertical stack when loaded in the magazine 182. FIG. 9 is a top view of the loaded magazine 182 of FIG. 8. In some embodiments, the width of the magazine 182 may be such that a single, vertically oriented stack of shotshell type ammunition 150 fits within the magazine 182, as shown in FIG. 9.

Figure 10:
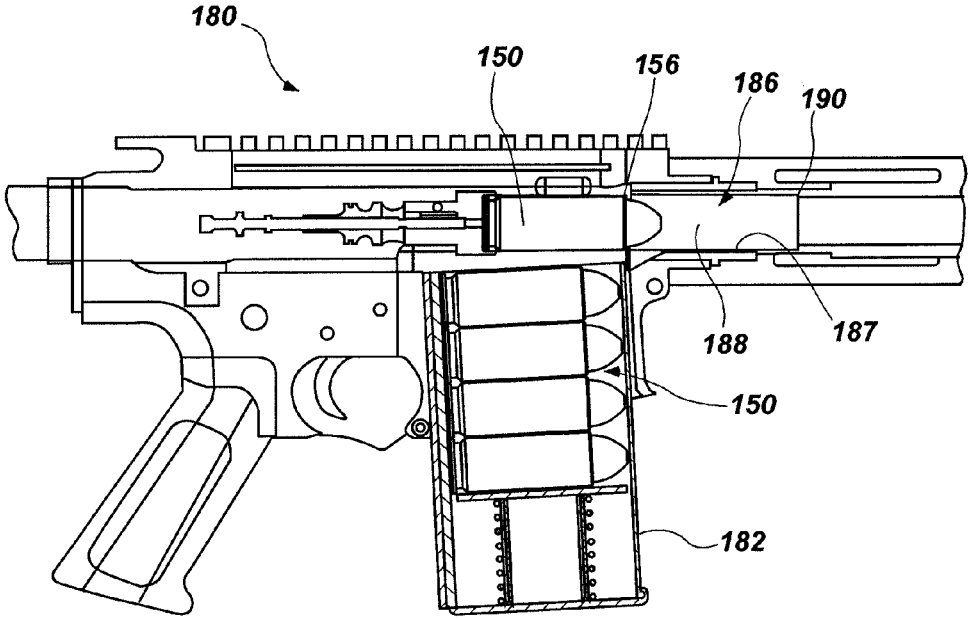
FIG. 10 is a partial cross-sectional side view of the shotgun type firearm of FIG. 7 illustrating a loaded magazine like that of FIGS. 8 and 9 attached to the firearm, and a shotshell type ammunition being moved from the magazine and into a firing chamber of the firearm.

FIG. 10 is an enlarged cross-sectional side view of a portion of the shotgun type firearm 180 of FIG. 7, with a loaded magazine 182 as shown in FIGS. 8 and 9 coupled to the firearm 180. FIG. 10 illustrates one ammunition 150 being fed from the magazine 182 and into a firing chamber 186 of the firearm 180. The firing chamber 186 of the shotgun type firearm 180 may be sized and configured to fire a shotshell type ammunition 150 as previously described herein.

Figure 11:
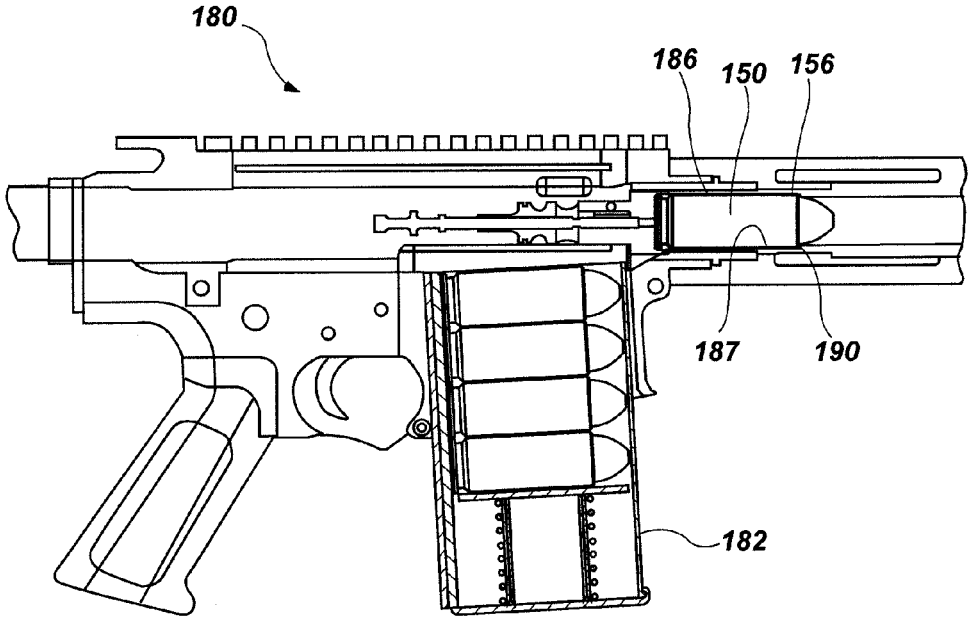
FIG. 11 is a partial cross-sectional side view like that of FIG. 10 illustrating a shotshell type ammunition fully loaded in the firing chamber of the firearm.

FIG. 11 shows a shotshell type ammunition 150 fully seated within the firing chamber 186. The firing chamber 186 of the shotgun type firearm 180 may have a generally cylindrical inner surface 187 extending through a headspace 188 within the firing chamber 186. The firing chamber 186 further includes a seat surface 190 that is located, sized, and configured to abut against the seat surface 168 of the ammunition 150 when the ammunition 150 is fully seated and properly head spaced within the firing chamber 186. Thus, the seat surface 190 may prevent longitudinal forward movement of the hull 152 within the firearm 180 when the shotshell type ammunition 150 is loaded and fired from the firearm. As used herein, the term "headspace" means a distance from the seat surface 186, which stops forward movement of the ammunition 150 within the firing chamber 186, to the surface at the rimless first end 154 of the hull 152 (FIG. 6), which is the surface against which the bolt of the firearm rests at the time of firing the ammunition 150.

The generally cylindrical inner surface 187 extending through the headspace 188 within the firing chamber 186 may have any appropriate length that is at least as long as the length L of the cylindrical lateral side surface 155 of the hull 152 of the ammunition 150. As non-limiting examples, the generally cylindrical inner surface 187 extending through the headspace 188 may have a length of at least about 0.318 centimeters (about ⅛ of an inch), at least about 0.635 centimeters (about ¼ of an inch), at least about 1.270 centimeters (about ½ of an inch), and at least about 2.540 centimeters (about 1 inch).

Figure 12:
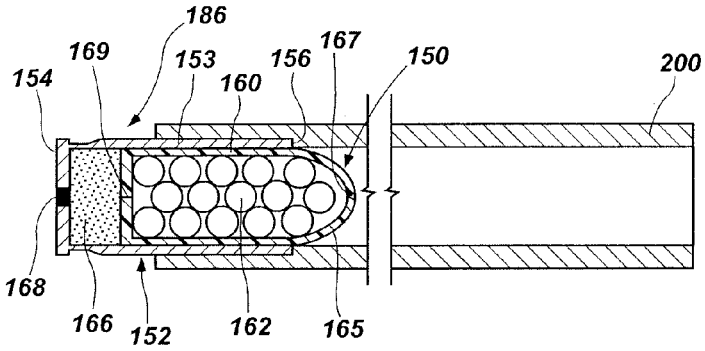
FIG. 12 is a partial cross-sectional side view illustrating a shotshell type ammunition fully loaded in the firing chamber of the firearm.
Figure 13:
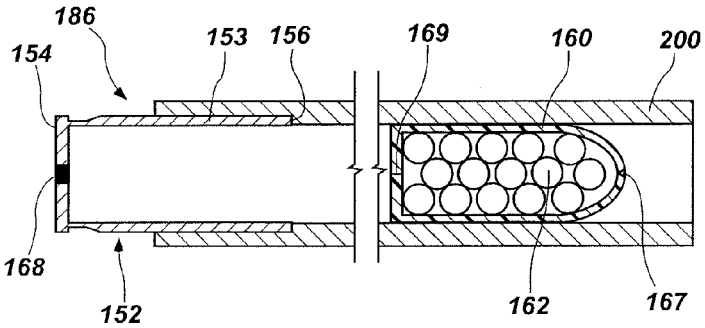
FIG. 13 is a partial cross-sectional side view like that of FIG. 12 illustrating a sabot carrying projectiles of the shotshell type ammunition moving through a barrel of the firearm after firing the shotshell type ammunition.
Figure 14:
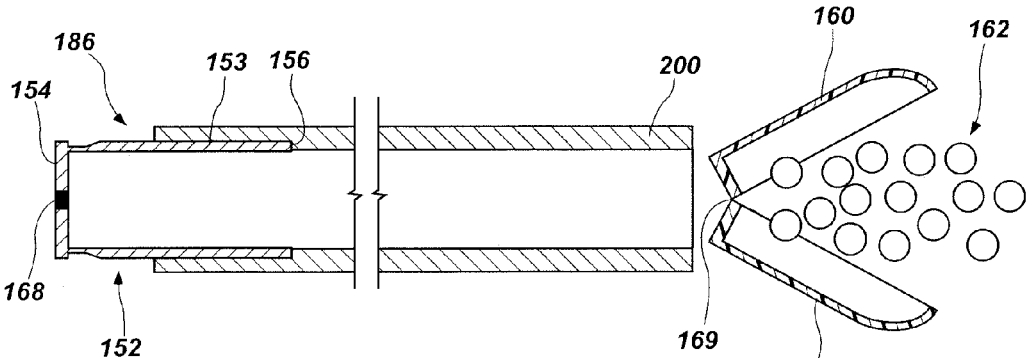
FIG. 14 is a partial cross-sectional side view like those of FIGS. 12 and 13 and illustrate the sabot opening and releasing the projectiles carried therein upon exiting the barrel of the firearm.

FIGS. 12 through 14 are simplified figures illustrating the firing of a shotshell type ammunition 150 as described herein within the barrel 200 of the shotgun type firearm 180 of FIGS. 7 through 11. FIG. 12 illustrates the shotshell type ammunition 150 fully seated within the firing chamber 186 prior to firing the ammunition 150. As previously discussed, the shotshell type ammunition 150 may comprise a hull 152 and a sabot 160 disposed within the hull 152. The sabot 160 may carry one or more projectiles 162 therein, as previously described.

As shown in FIG. 13, upon firing the ammunition 150, the sabot 160 carrying the one or more projectiles 162 therein exits the hull 152 and travels down the barrel 200 of the firearm 180. The one or more projectiles 162 may remain at least substantially enclosed within the sabot 160 as the sabot 160 travels through the barrel 200.

Referring to FIG. 14, as the sabot 160 exits the barrel 200, the two or more portions of the sabot 160 may at least partially separate from one another in such a manner as to release the one or more projectiles 162. As the sabot 160 travels through the air, the air impinging upon the sabot 160 within the recess or aperture 167 may generate forces that urge the separation of the two or more portions of the sabot 160. The opening or separation of the sabot 160 may be further assisted by providing a pressurized gas within the sabot 160, which may urge the separation of the two or more portions of the sabot 160 and assist in releasing the one or more projectiles 162 from the sabot 160 and allowing the trajectory of the one or more projectiles 162 to continue on toward an intended target, while the sabot 160 rapidly decelerates and falls to the ground in relatively closer proximity to the barrel 200. Such a pressurized gas may be provided within the sabot 160 by providing an aperture in the sabot 160 that extends through the end of the sabot 160 proximate the gun powder, so as to allow the pressurized gases generated by the gun powder upon filing of the ammunition 150 to enter into the interior of the sabot 160 as the sabot 160 travels through the barrel 200 of the firearm.

The various embodiments of shotshell type ammunition described herein with reference to FIGS. 1 through 6 are configured to facilitate use of shotshell type ammunition in semi-automatic or automatic shotgun type firearms that include a removable magazine, such as the firearm 180 described with reference to FIGS. 7 through 11. In particular, by utilizing a hull having a rimless first firing end, and a generally cylindrical side surface defining a maximum diameter of the hull, which extends a distance from the rimless first firing end to a seat surface, the ammunition may be consistently stacked within a magazine in a uniform and predictable manner, which may allow consistent feeding of ammunition from the magazine and into the firing chamber of the firearm without jamming.

Figure 15:
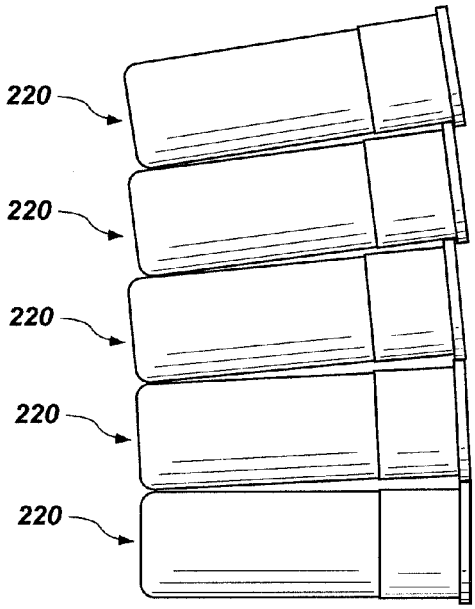
FIG. 15 (PRIOR ART)
FIG. 15 is a side view illustrating a stack of shotshell type ammunition of a previously known configuration.

For example, FIG. 15 illustrates a stack of previously known standard shotshell type ammunition 220, which have rimmed first firing ends. Due to the shape and configuration of the ammunition 220, the ammunition may not be oriented substantially parallel to one another when they are stacked one upon another as shown in FIG. 15. As a result, when such ammunition 220 is stacked one upon another in a magazine, the ammunition 220 may not be capable of feeding from the magazine into a firing chamber of a firearm in a reliable and consistent manner without jamming.

Figure 16:
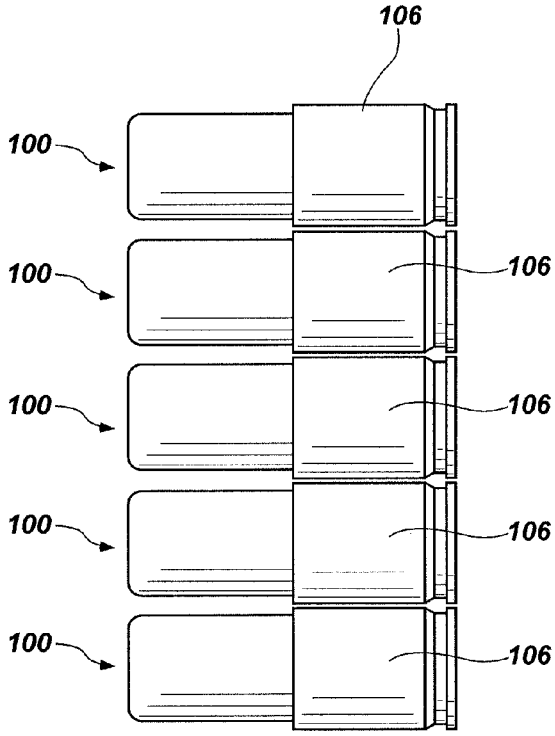
FIG. 16 is a side view illustrating a stack of shotshell type ammunition as described herein.

In contrast, FIG. 16 illustrates a stack of shotshell type ammunition 100 as described herein with reference to FIGS. 1 and 2. As shown in FIG. 16, the shotshell type ammunition 100 may be oriented substantially parallel to one another when stacked one upon another, such as within a magazine 182 as described herein. The outer cylindrical side surfaces 106 of the ammunition 100 abut against one another in such a manner as to cause the ammunition 100 to align parallel to one another in the stack. The lack of a rimmed end on the ammunition 100 further enables the ammunition 100 to be stacked in a parallel configuration. As a result, the ammunition 100 may be capable of feeding from the magazine 182 and into a firing chamber of a firearm 180 in a relatively more reliable and consistent manner without jamming, as compared to previously known standard shotshell ammunition 220 (FIG. 15).

Another advantage of the various embodiments of shotshell type ammunition described herein is that the ammunition (and corresponding shotgun type firearms) may be configured differently for use with lethal and less-lethal ammunition, so as to prevent lethal ammunition from being fired from firearms intended for use only with less-lethal ammunition. For example, referring again to FIGS. 1 and 2, the distance L from the outer end surface 114 of the hull 102 to the rimless first end 104 may be configured to correspond to a specific configuration of the shotshell type ammunition 100. For example, a first type of lethal ammunition 100 (i.e., carrying one or more lethal projectiles 120) may have a different length L compared to a second type of less-lethal ammunition 100 (i.e., carrying one or more less-lethal or non-lethal projectiles 120). Further, a barrel of a shotgun type firearm may be configured to be compatible only with shotshell type ammunition having a specific length L. For example, in one embodiment, a lethal shotgun type firearm may be configured to be compatible with only lethal shotshell type ammunition having a specific distance L, while a non-lethal or less-lethal shotgun type firearm may be configured to be compatible only with a non-lethal or less-lethal shotshell type ammunition having a shorter specific distance L. In such a configuration, the lethal shotshell type ammunition would be too long to fit properly within the firing chamber of the non-lethal shotgun type firearm, and, therefore, the lethal ammunition would not fire in the non-lethal shotgun type firearm. Such a configuration may aid in limiting accidents when only one type of shotshell ammunition is intended to be used with a specific shotgun type firearm. The other embodiments of shotshell type ammunition described herein also may be configured differently for lethal and less-lethal ammunition, and corresponding firearms may be fabricated and configured for use with one of the lethal or less-lethal types of ammunition, so as to prevent lethal ammunition from being fired from a firearm intended for use only with less-lethal (e.g., non-lethal) types of ammunition.

Additional non-limiting example embodiments of the disclosure are set forth below.

Embodiment 1

A shotshell type ammunition, comprising: a hull having a rimless first end comprising a primer for firing the ammunition, an opposing second end from which a projectile may be ejected out from the hull upon firing the ammunition, a seat surface for seating the hull against a complementary seat surface in a firing chamber of a firearm, the seat surface located a distance from an outer end surface of the hull at the rimless first end, and an outer cylindrical side surface extending from the rimless first end of the hull to the seat surface of the hull; a sabot disposed within the hull; and at least one projectile disposed within the sabot.

Embodiment 2

The shotshell type ammunition of embodiment 1, wherein the distance the seat surface is located from the outer end surface of the hull at the rimless first end is at least about 0.318 centimeters (about ⅛ of an inch).

Embodiment 3

The shotshell type ammunition of embodiment 2, wherein the distance the seat surface is located from the outer end surface of the hull at the rimless first end is at least about 0.635 centimeters (about ¼ of an inch).

Embodiment 4

The shotshell type ammunition of embodiment 3, wherein the distance the seat surface is located from the outer end surface of the hull at the rimless first end is at least about 1.270 centimeters (about ½ of an inch).

Embodiment 5

The shotshell type ammunition of embodiment 4, wherein the distance the seat surface is located from the outer end surface of the hull at the rimless first end is at least about 2.540 centimeters (about 1 inch).

Embodiment 6

The shotshell type ammunition of any one of embodiments 1 through 5, wherein the hull has a maximum diameter of about 2.159 centimeters (about 0.850 inches) or less.

Embodiment 7

The shotshell type ammunition of any one of embodiments 1 through 6, wherein the outer cylindrical side surface has a first diameter, and wherein the outer end surface of the hull at the rimless first end has a second diameter at least substantially equal to or smaller than the first diameter.

Embodiment 8

The shotshell type ammunition of any one of embodiments 1 through 7, further comprising a groove extending into the hull on a lateral side of the hull proximate the rimless first end of the hull, the groove located and configured for use in ejection of the shotshell type ammunition from a firearm.

Embodiment 9

The shotshell type ammunition of any one of embodiments 1 through 8, wherein the hull comprises: a cylindrical portion extending from the rimless first end; and a cylindrical ring member disposed concentrically around the cylindrical portion, wherein an end surface of the cylindrical ring member defines the seat surface of the hull, and wherein an outer cylindrical side surface of the cylindrical ring member defines the outer cylindrical side surface of the hull extending from the rimless first end of the hull to the seat surface of the hull.

Embodiment 10

The shotshell type ammunition of embodiment 9, wherein the cylindrical portion comprises a plastic material.

Embodiment 11

The shotshell type ammunition of embodiment 10, wherein the cylindrical ring member comprises a metal.

Embodiment 12

The shotshell type ammunition of any one of embodiments 1 through 8, wherein the hull comprises a cylindrical portion extending from the rimless first end of the hull to an open end of the cylindrical portion defining the second end of the hull from which the projectile may be ejected out from the hull upon firing the ammunition, wherein an end surface of the cylindrical portion defines the seat surface of the hull, and wherein an outer cylindrical side surface of the cylindrical portion defines the outer cylindrical side surface of the hull extending from the rimless first end of the hull to the seat surface of the hull.

Embodiment 13

The shotshell type ammunition of embodiment 12, wherein the sabot projects longitudinally beyond the end surface at the open end of the cylindrical portion prior to firing of the shotshell type ammunition.

Embodiment 14

The shotshell type ammunition of embodiment 12 or 13, wherein the sabot has a rounded end surface, the rounded end surface of the sabot projecting beyond the end surface at the open end of the cylindrical portion prior to firing of the shotshell type ammunition.

Embodiment 15

The shotshell type ammunition of any one of embodiments 12 through 14, wherein the sabot is retained within the hull using an interference fit between the sabot and the hull.

Embodiment 16

The shotshell type ammunition of any one of embodiments 12 through 15, wherein the sabot has a cylindrical outer side surface having a maximum diameter, and wherein the hull has a cylindrical inner side surface having a minimum diameter equal to or smaller than the maximum diameter of the of the cylindrical outer side surface.

Embodiment 17

The shotshell type ammunition of any one of embodiments 12 through 16, wherein the cylindrical portion and the rimless first end of the hull are regions of a single unitary body.

Embodiment 18

The shotshell type ammunition of embodiment 17, wherein the single unitary body comprises a plastic material.

Embodiment 19

The shotshell type ammunition of any one of embodiments 1 through 18, wherein the at least one projectile disposed within the sabot comprises a plurality of rounded pellets.

Embodiment 20

A shotgun type firearm, comprising: a firing chamber sized and configured to fire a shotshell type ammunition; a generally cylindrical inner surface extending through a headspace within the firing chamber, the generally cylindrical inner surface having a length of at least about 0.318 centimeters (about ⅛ of an inch); and a seat surface within the firing chamber, the seat surface configured to abut against a complementary seat surface of a hull of a shotshell type ammunition to be fired from the firearm and to prevent longitudinal forward movement of the hull within the firearm when the shotshell type ammunition is fired from the firearm.

Embodiment 21

The shotgun type firearm of embodiment 20, wherein the firearm comprises a magazine sized and configured to store a plurality of shotshell type ammunitions within the magazine and to sequentially feed shotshell type ammunitions into the firing chamber of the firearm.

Embodiment 22

The shotgun type firearm of embodiment 21, wherein the firearm and the magazine are configured for movable detachment of the magazine from the firearm and reattachment of the magazine to the firearm during normal use of the shotgun type firearm.

Embodiment 23

The shotgun type firearm of any one of embodiments 20 through 22, wherein the shotgun type firearm is a semi-automatic or automatic repeating firearm.

Embodiment 24

The shotgun type firearm of any one of embodiments 20 through 23, wherein the generally cylindrical inner surface extending through the headspace within the firing chamber has a length of at least about 0.635 centimeters (about ¼ of an inch).

Embodiment 25

The shotgun type firearm of embodiment 24, wherein the generally cylindrical inner surface extending through the headspace within the firing chamber has a length of at least about 1.270 centimeters (about ½ of an inch).

Embodiment 26

The shotgun type firearm of embodiment 25, wherein the generally cylindrical inner surface extending through the headspace within the firing chamber has a length of at least about 2.540 centimeters (about 1 inch).

Embodiment 27

A method of manufacturing a shotshell type ammunition, comprising: forming a hull having a rimless first end, an opposing second end from which a projectile may be ejected out from the hull upon firing the ammunition, a seat surface for seating the hull against a complementary seat surface in a firing chamber of a firearm, the seat surface located a distance from an outer end surface of the hull at the rimless first end, and an outer cylindrical side surface extending from the rimless first end of the hull to the seat surface of the hull; providing a primer at the rimless first end of the hull for firing the ammunition; providing at least one projectile within a sabot; and inserting the sabot at least partially into the hull.

Embodiment 28

The method of embodiment 27, further comprising forming the hull such that the distance the seat surface is located from the outer end surface of the hull at the rimless first end is at least about 0.318 centimeters (about ⅛ of an inch).

Embodiment 29

The method of embodiment 28, further comprising forming the hull such that the distance the seat surface is located from the outer end surface of the hull at the rimless first end is at least about 0.635 centimeters (about ¼ of an inch).

Embodiment 30

The method of embodiment 29, further comprising forming the hull such that the distance the seat surface is located from the outer end surface of the hull at the rimless first end is at least about 1.270 centimeters (about ½ of an inch).

Embodiment 31

The method of embodiment 30, further comprising forming the hull such that the distance the seat surface is located from the outer end surface of the hull at the rimless first end is at least about 2.540 centimeters (about 1 inch).

Embodiment 32

The method of any one of embodiments 27 through 31, further comprising forming the hull such that the outer cylindrical side surface has a first diameter, and such that the outer end surface of the hull at the rimless first end has a second diameter at least substantially equal to or smaller than the first diameter.

Embodiment 33

The method of any one of embodiments 27 through 32, further comprising forming the hull to include a groove extending into the hull on a lateral side of the hull proximate the rimless first end of the hull, the groove located and configured for use in ejection of the shotshell type ammunition from a firearm.

Embodiment 34

The method of any one of embodiments 27 through 33, wherein faulting the hull further comprises: forming a cylindrical portion extending from the rimless first end; and disposing a cylindrical ring member concentrically around the cylindrical portion, an end surface of the cylindrical ring member defining the seat surface of the hull, and an outer cylindrical side surface of the cylindrical ring member defining the outer cylindrical side surface of the hull extending from the rimless first end of the hull to the seat surface of the hull.

Embodiment 35

The method of any one of embodiments 27 through 33, wherein forming the hull further comprises forming a cylindrical portion extending from the rimless first end of the hull and having an open end of the cylindrical portion defining the second end of the hull from which the projectile may be ejected out from the hull upon firing the ammunition, an end surface of the cylindrical portion defining the seat surface of the hull, an outer cylindrical side surface of the cylindrical portion defining the outer cylindrical side surface of the hull extending from the rimless first end of the hull to the seat surface of the hull.

Embodiment 36

The method of embodiment 35, further comprising configuring the sabot to project out from the hull longitudinally beyond the end surface at the open end of the cylindrical portion prior to firing of the shotshell type ammunition.

Embodiment 37

The method of embodiment 35 or 36, further comprising providing a rounded end surface on the sabot, the rounded end surface of the sabot projecting beyond the end surface at the open end of the cylindrical portion prior to firing of the shotshell type ammunition.

Embodiment 38

The method of any one of embodiments 35 through 37, wherein inserting the sabot at least partially into the hull comprises retaining the sabot within the hull with an interference fit between the sabot and the hull.

Embodiment 39

The method of embodiment 38, wherein inserting the sabot at least partially into the hull further comprises press fitting the sabot at least partially into the hull.

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternate useful combinations of the elements described, will become apparent to those skilled in the art from the description. Such modifications and embodiments are also intended to fall within the scope of the appended claims.

The invention claimed is:

1. In combination, a semi-automatic or automatic shotgun loaded with a rimless shotshell ammunition, comprising:

a barrel having an interior surface defining a bore without a forcing cone;

a firing chamber in which the rimless shotshell ammunition is chambered;

a generally cylindrical inner surface extending through a headspace within the firing chamber, the generally cylindrical inner surface having a length of at least about 1.270 centimeters (about ½ of an inch);

a seat surface within the firing chamber, the seat surface abutting against a complementary seat surface of a hull of the rimless shotshell ammunition and preventing longitudinal forward movement of the hull within the shotgun when the shotshell ammunition is fired from the shotgun, the interior surface of the barrel defining the bore having an at least substantially uniform diameter extending from the seat surface within the firing chamber to a location proximate a distal end of the barrel; and wherein the rimless shotshell ammunition comprises:

a polymeric hull having a rimless first end comprising a primer, a second end of the hull defining the complementary seat surface of the hull, a sabot disposed within the hull; and at least one projectile disposed within the sabot.

2. The shotgun loaded with the rimless shotshell ammunition of claim 1, wherein the shotgun comprises a magazine sized and configured to store a plurality of shotshell ammunitions within the magazine and to sequentially feed shotshell ammunitions into the firing chamber of the shotgun.

3. The shotgun loaded with the rimless shotshell ammunition of claim 2, wherein the shotgun and the magazine are configured for movable detachment of the magazine from the shotgun and reattachment of the magazine to the shotgun during normal use of the shotgun.

4. The shotgun loaded with the rimless shotshell ammunition of claim 1, wherein the generally cylindrical inner surface extending through the headspace within the firing chamber has a length of at least about 2.540 centimeters (about 1 inch).

5. The shotgun loaded with the rimless shotshell ammunition of claim 1, wherein the shotgun comprises a magazine sized and configured to store a plurality of vertically stacked shotshell ammunitions within the magazine and to sequentially feed vertically stacked shotshell ammunitions into the firing chamber of the shotgun.

6. In combination, a semi-automatic or automatic shotgun loaded with a rimless shotshell ammunition, comprising:

a barrel having an interior surface defining a bore;

a firing chamber in which the rimless shotshell ammunition is chambered, the rimless shotshell ammunition having a rimless hull;

a seat surface at one end of a headspace and within the firing chamber, the seat surface abutting against a complimentary seat surface of the rimless hull of the rimless shotshell ammunition, wherein the seat surface is configured to prevent longitudinal forward movement of the rimless hull within the shotgun when the rimless shotshell ammunition is fired from the shotgun;

a generally cylindrical inner surface extending through the headspace within the firing chamber, the generally cylindrical inner surface having a length of at least about 2.54 centimeters (about one inch); and a magazine sized and configured to store a plurality of shotshell ammunitions having rimless hulls within the magazine and sequentially feed shotshell ammunitions having rimless hulls into the firing chamber of the shotgun, the shotgun and the magazine being configured for detachment of the magazine from the shotgun and reattachment of the magazine to the shotgun during use of the shotgun;

wherein the rimless shotshell ammunition comprises:

a polymeric hull having a rimless first end comprising a primer;

a second end of the hull defining the complementary seat surface of the hull;

a sabot disposed within the hull; and at least one projectile disposed within the sabot.

7. The shotgun loaded with the rimless shotshell ammunition of claim 6, wherein the interior surface of the barrel has an at least substantially uniform diameter extending from the seat surface within the firing chamber to a location proximate a distal end of the barrel.

8. In combination, A shotgun, a shotgun loaded with a rimless shotshell ammunition comprising:

a barrel having an interior surface defining a bore without a forcing cone;

a firing chamber in which the rimless shotshell ammunition is chambered;

a generally cylindrical inner surface extending through a headspace within the firing chamber and terminating at a seat surface, wherein the seat surface abuts against a complimentary seat surface of a hull of the rimless shotshell ammunition, wherein the generally cylindrical inner surface has a diameter between about 1.775 centimeters (about 0.699 inches) and about 2.370 centimeters (about 0.933 inches), and wherein the seat surface is substantially perpendicular to the generally cylindrical inner surface; and a barrel having an interior surface, wherein the interior surface has an at least substantially uniform diameter extending from the seat surface within the firing chamber to a location proximate a distal end of the barrel;

wherein the rimless shotshell ammunition comprises:

a polymeric hull having a rimless first end comprising a primer;

a second end of the hull defining the complementary seat surface of the hull;

a sabot disposed within the hull; and at least one projectile disposed within the sabot.

9. The shotgun loaded with the rimless shotshell ammunition of claim 8, wherein the shotgun comprises a magazine sized and configured to store a plurality of shotshell ammunitions within the magazine and to sequentially feed shotshell ammunitions into the firing chamber of the shotgun.

10. The shotgun loaded with the rimless shotshell ammunition of claim 9, wherein the shotgun and the magazine are configured for detachment of the magazine from the shotgun and reattachment of the magazine to the shotgun during use of the shotgun.

11. The shotgun loaded with the rimless shotshell ammunition of claim 8, wherein the generally inner surface extending through a headspace within the firing chamber is at least as long as a length of a cylindrical lateral side surface of the hull of the shotshell ammunition to be fired from the shotgun.

12. In combination, a shotgun loaded with a rimless shotshell ammunition, comprising:

a barrel having an interior surface defining a bore without a forcing cone;

a firing chamber in which the rimless shotshell ammunition is chambered;

a generally cylindrical inner surface of the shotgun extending through a headspace within the firing chamber, the generally cylindrical inner surface having a length of at least about 1.270 centimeters (about ½ of an inch) and a maximum diameter in a range extending from about 1.775 centimeters (about 0.699 inches) to about 2.370 centimeters (about 0.933 inches); and a seat surface within the firing chamber, the seat surface abutting against a complementary seat surface of a hull of the rimless shotshell ammunition and preventing longitudinal forward movement of the hull within the shotgun, the interior surface of the barrel defining the bore having an at least substantially uniform diameter extending from the seat surface within the firing chamber to a location proximate a distal end of the barrel;

wherein the rimless shotshell ammunition comprises:

a polymeric hull having a rimless first end comprising a primer for firing the ammunition, an opposing second end from which a projectile may be ejected out from the hull upon firing the ammunition, a cylindrical portion extending from the rimless first end to an open end of the cylindrical portion at the second end of the hull, an end surface of the cylindrical portion at the second end of the hull defining the seat surface of the hull, the seat surface of the hull located a distance from an outer end surface of the hull at the rimless first end, and an outer cylindrical side surface of the cylindrical portion extending from the rimless first end of the hull to the seat surface of the hull, the distance the seat surface is located from the outer end surface of the hull at the rimless first end is at least about 1.270 centimeters (about ½ of an inch), and the hull has a maximum diameter in a range extending from about 1.775 centimeters (about 0.699 inches) to about 2.370 centimeters (about 0.933 inches);

a sabot disposed within the hull; and at least one projectile disposed within the sabot.

* * * * *